United States Patent [19]

Harriman et al.

[11] 4,116,469

[45] Sep. 26, 1978

[54] COMBINED PAYMENT AND RECEIPT FORM AND METHOD OF USING

[76] Inventors: Russell H. Harriman, 30335 Woodhaven Ln., Birmingham, Mich. 48010; Timothy T. May, 25 Crestwood, Gross Point Shores, Mich. 48236

[21] Appl. No.: 822,806

[22] Filed: Aug. 8, 1977

[51] Int. Cl.[2] ..... B42D 15/00

[52] U.S. Cl. ..... 282/23 R; 283/6; 283/59

[58] Field of Search ..... 282/1, 22 R, 23 R, 8 R, 282/8 A, 8 C; 283/6, 57, 58, 59; 35/9 H

[56] References Cited

U.S. PATENT DOCUMENTS

| | | | |
|---|---|---|---|
| 3,257,129 | 6/1966 | Malone | 282/23 R |
| 3,281,960 | 11/1966 | Gross | 35/9 H |

*Primary Examiner*—J. M. Meister
*Attorney, Agent, or Firm*—Robert B. Gerhardt

[57] ABSTRACT

A combination payment and receipt form and method of using the same has a first top thin sheet with printed indicia areas that are filled in by the user. Transfer means are provided to transfer this information in a first predetermined color to a second bottom sheet of a size and thickness suitable for use as a postcard. The second lower card sheet has a background camouflage area printed in another predetermined color located in the area where the information is transferred, with the transferred information normally not readily distinguishable against the background pattern. The upper and lower sheets are then mailed to a second party who indicates an acknowledgment on the card sheet and returns the same as a postcard to the user. The user then views the returned card through a filter medium that freely transmits the other predetermined color and renders the information transferred in the first color darker than the background pattern. Address means may be provided for mailing the card back to the first party.

6 Claims, 4 Drawing Figures

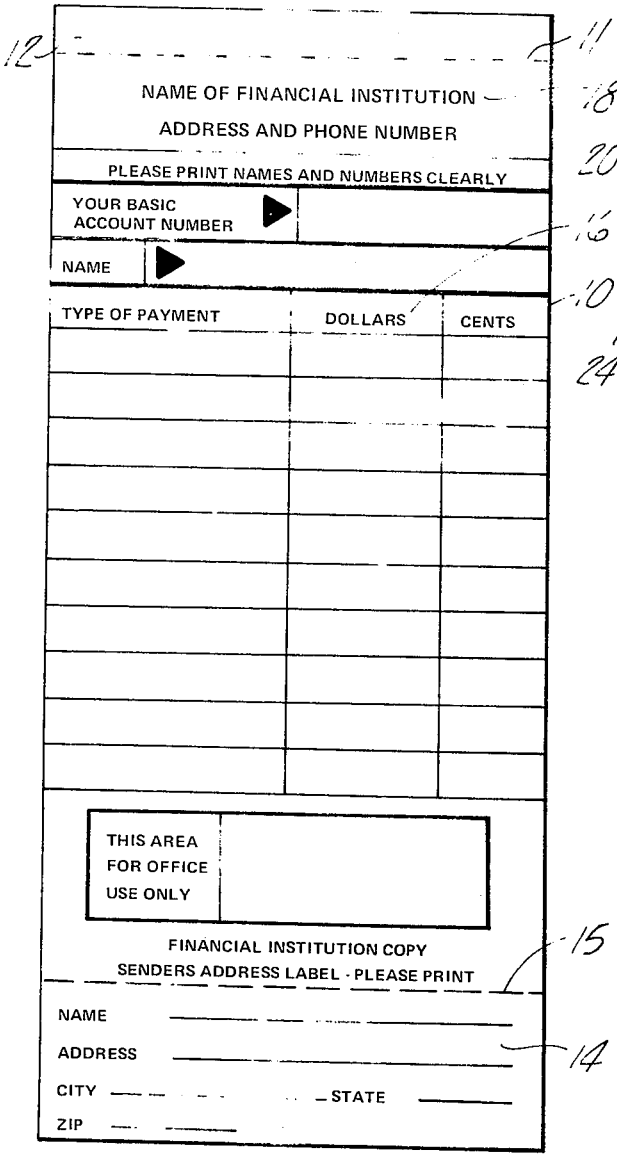
Fig-1
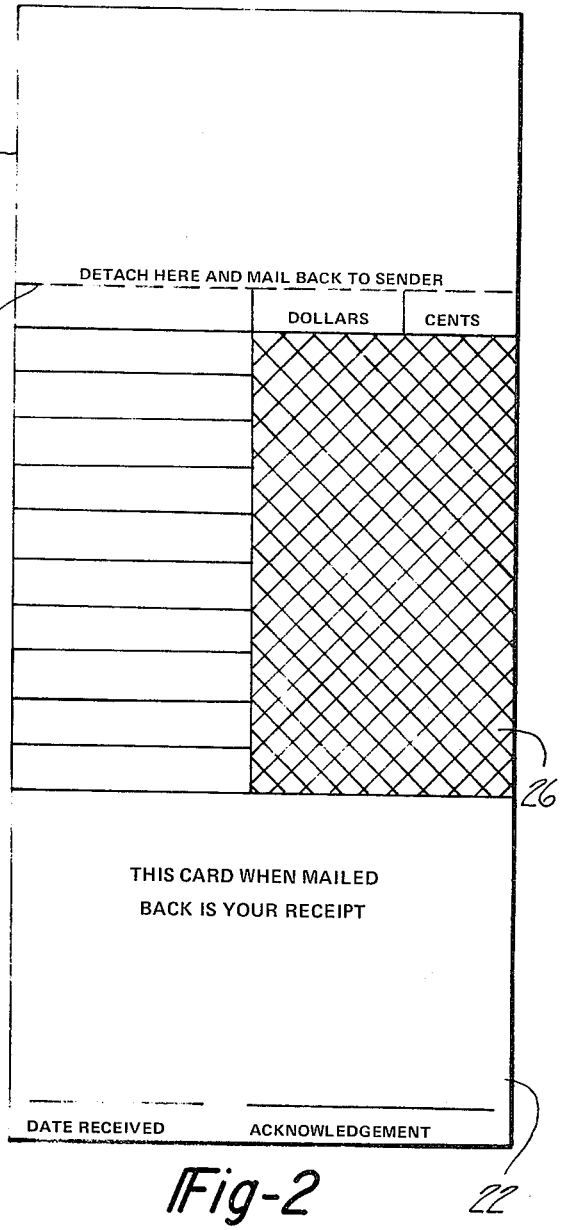
Fig-2
Fig-3
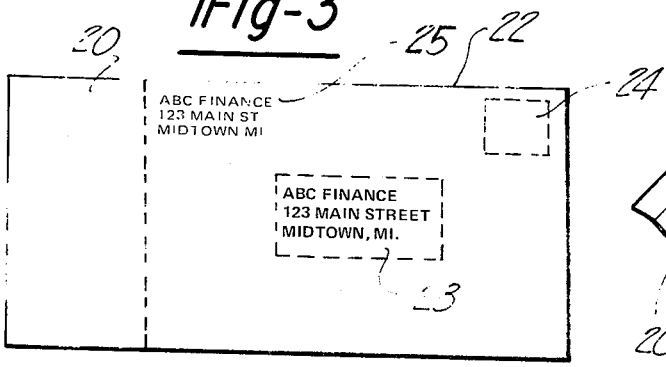
Fig-4
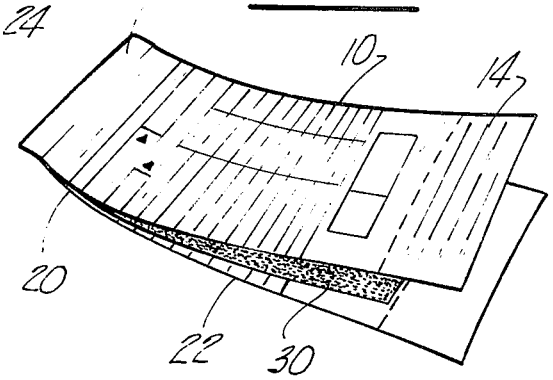

COMBINED PAYMENT AND RECEIPT FORM AND METHOD OF USING

This invention relates to financial payment and receipt devices and a method of using the same and more particularly to a method utilizing a novel two-part payment and receipt set that enables selected viewing of payment information on one part of the form.

Many proposals have been made to simplify and reduce the expense of the many types of transactions involving exchange of financial information and transmission of money items. While some of these proposals have had commercial usage they do not fully meet the desired objectives and usually involve expensive complicated multipart forms, envelopes, etc. With the rapid change of the method of making these transactions from mostly personal visits to mostly mail transactions, the problem of providing simple low cost transactions is multiplied. There are at the present time over 250,000 financial institutions including banks, credit unions, savings and loan associations, stores, insurance companies, charitable organizations, etc., which handle many millions of mail transactions each day. Thus, it is clear that any savings in material or labor cost for each transaction can have a large collective savings for each institution as well as for the economy as a whole.

In the copending application entitled Combined Bank Deposit Slip and Mailing Label, Ser. No. 742,754 filed Nov. 18, 1976 in the name of Russell H. Harriman, there is shown a device which permits simple yet efficient transmission of deposit information to a financial institution from a payor. When used with the receipt device and method shown and described in the copending application entitled, Method and Device for Transmitting Deposit Information, Ser. No. 742,769, filed Nov. 18, 1976 in the name of Russell H. Harriman it is possible to provide efficient low cost bank account deposit transmission and return receipt of deposit information to the depositor. The present invention constitutes a variation on the two above identified copending applications in that it permits the transmission of monetary payments other than bank deposits and accompanying necessary notice of receipt thereof in a similar low cost efficient manner.

The invention shown and described in the aforementioned Combined Bank Deposit Slip and Mailing Label, application Ser. No. 742,754, includes a preprinted form having the payor or depositor's name, address and account number information preprinted thereon with the necessary payment and deposit information written thereon by the depositor. Subsequently this payment or deposit information is transferred by the financial institution personnel to a special receipt postcard with such deposit information imprinted in a predetermined color such as green on a camouflage background pattern of a second color such as red. The postcard receipt is then mailed back to the depositor who, upon receipt of the same, views the card through a special filter which acts to freely transmit the color of the background pattern but restricts transmission of the color of the imprinted information. The name and address of the depositor may be preprinted on a detachable label part of the original deposit form and the financial institution merely has to later attach the label on the postcard before mailing the same.

In the last mentioned system preprinted deposit slips are required. Furthermore, it is necessary for the financial institution to transfer the payment information to the return postcard. In many types of payments such as those made to credit unions, finance and loan companies, stores, etc., it is usually not possible to furnish forms with the depositor's name and address preprinted thereon. Furthermore, the step of transferring the payment information to the postcard requires writing, keying, punching or otherwise entering the correct information.

It is therefore an object of the present invention to provide a novel combined payment slip and return card and a novel method of using which does not require forms preprinted with each payor's name and address and which, the return card including payment information is not readily readable without a special viewing device.

It is a further object to provide a combination payment and receipt set and method of using the same which avoids the necessity of transferring payment information to the card by the financial institution.

These and other objects will be readily apparant from the following description and accompanying drawing in which:

FIG. 1 is a view of the front side of the upper sheet;

FIG. 2 is a similar view of the front side of the lower sheet;

FIG. 3 is a reduced sized view of the reverse side of the lower sheet; and

FIG. 4 is a perspective view of the two-part form set with a carbon sheet shown inserted between the upper and lower forms.

Referring to FIG. 1 an upper or top payment sheet or form 10 includes a fastening end part 12 detachably connected at a perforated line 15. The sheet 10 has preprinted indicia thereon on area 16 for the recording of payment information and also the name and address of the financial institution. The top form 10 is made of ordinary weight paper which permits transfer of writing pressure through the same to the surface of a sheet located below the top sheet.

A lower or bottom receipt sheet or form 20, having the same overall size as the top sheet, is made of card stock between 0.006 and 0.010 inches in thickness and consequently suitable for mailings as a postcard. The bottom form 20 includes a main portion 22 detachably connected at a weakened or perforated line to an end fastening part 20. The main portion 22 is of a size suitable for mailing as a postcard.

The bottom form 22 has imprinted thereon a camouflage background pattern 26. This pattern may be of any suitable design such as random or geometric designs, letters, symbols, etc. This pattern is similar to the camouflage pattern shown and described in the above mentioned application Ser. No. 742,769. The pattern is printed in a predetermined color which renders the imprinting thereon in a second specific color difficult or impossible to read. The effect thereof acts to disguise or conceal any information imprinted in the second color unless the same is viewed through a particular filter medium that freely transmits the first color but restricts transmission of the second color. The net effect is to render the imprinting in the second color considerably darker than the first color and thus render information printed in the second color visable to the viewer.

As disclosed in application Ser. No. 742,769, it has been found that a suitable ink color for the background is a red having a relatively narrow color frequency range, the imprinting ink color a narrow range green and the viewing filter having good transmission properties for the same red color but not the green.

In addition to the camouflage pattern 26, the top surface of the bottom sheet includes indicia for recording receipt acknowledgement information such as data, initials as well as printed instructions.

The reverse side of the bottom sheet as shown in FIG. 3, includes a postage area 24, a return address area 25 and a mailing address area 28. The name and address of the financial institution may be preprinted in the return address area 25. Likewise the same name and address may be preprinted in the main address area 28. The complete upper and lower sheets 10 and 22 are secured together by an adhesive, staple or other means with ends 12 and 20 forming the common connected part as seen in FIG. 4.

The preferred embodiment shown in FIG. 4 includes a carbon sheet 30 as a means of transferring imprinting or writing from the top sheet to the bottom sheet. The carbon sheet 30 is selected to imprint in the selected color not easily usable against the background unless viewed through the proper filter. As stated above, a suitable color is green when imprinted on a red background pattern. The carbon sheet may be eliminated if the top and lower sheets comprise a carbonless or "NCR" set wherein the under or back surface of the top sheet and the top surface of the lower sheet cooperate to transfer information entered on the top sheet to the bottom sheet. Again the resulting imprinted color on the bottom sheet should be a predetermined proper color. More or less of the card may be covered with the camouflage background pattern. The essential requirement is that the amount, that is the dollars and cents information be located over a camouflage pattern portion.

The combination payment and receipt set is used as follows. The financial institution provides to its customers a supply of payment sets which may be loose or stapled or otherwise fastened in groups to form a book. The user, when wishing to send a payment to the institution, fills in the proper spaces on the top sheet 10 including his account number, the type of payment if necessary, the amount of the payment and his name and address on the label portion 14. The payment information is transferred to the lower sheet 20 by the carbon sheet 30 or if a carbonless set is used by the impression transfer between the sheets.

The user than separates the top sheet 10 at line 11 and the lower card stock sheet 20 at 24. The carbon sheet, if used is discarded. The pair of sheets are then inserted in a window envelope along with the payment checks or money orders. In the preferred method of using, the envelope is of a conventional window type and the payment sheets and payment are inserted by the user so that the financial institution address preprinted on the rear surface of the card sheet at 28 is exposed through the envelope window. Alternatively the user could use a preprinted envelope furnished by the financial institution with its address printed thereon. Obviously the assemblage could be inserted in any other type envelope with the name and address written on the same by the user.

Upon receipt of the payment by the financial institution, the payment amount is checked against the amounts written on the forms. Receipt acknowledgement is then written or stamped on the card sheet. The address label 14 is then removed or torn from the top sheet and applied by adhesive to the address location on the card. If the financial institutions address was previously printed on the front face, this will be covered by the address label. Postage is then applied to the card by a postage machine or a postage stamp and deposited in the mail.

Upon receipt by the user, the user can verify that the amounts of payment shown are those that he or she wrote by viewing the same through a filter medium such as the transparent plastic sheet provided by the financial institution either at the time the account was opened or along with each supply of payment forms. Since the payment amount was written by the payor himself or herself, there is less chance of error in the payment amount than when personnel of the financial institution transcribes the information from one form to another.

In the event that the payor did make a mistake in the amount or type written, the financial institution personnel would merely assemble the upper and lower sheets in proper alignment, and either with the proper color carbon sheet or the effect of the "NCR" characteristics, make the necessary correction. This correction would be visable to the payor when the returned card is received and viewed through the proper filter.

As an alternative arrangement the address portion 14 of the top sheet could either not be used or left off the form. In this case the payor would write his name and address directly in the address location 28 on the return card. In this usage the preprinted financial institution address could not be used in the window envelope manner but only in a non-window envelope. Other methods of providing the name and address of the financial institution will be obvious.

It will be seen that we have provided a simple payment and receipt form set and method of using the same that reduces the number of pieces of material that must be used for a two-way financial transaction. Thus, the two-part form, and a carbon sheet if used, plus one envelope is all that is required for the complete two-way transaction. Only one first class postage on the first envelope and postcard postage on the return card is needed. The actual handling steps by both the payor and financial institution are reduced to a minimum with lower labor costs. Even though the receipt is a postcard the payment information is maintained in a confidential manner since the casual viewer such as postal employees cannot read this information without a special filter aid.

Other arrangements and uses of the combination two part set including a first thin sheet and a second postcard with the camouflage imprinted area and the two color concealment feature are deemed to be within the scope of the invention which is limited only by the following claims:

We claim:

1. A combined payment and receipt form set for use in mailing a payment from a first party to a financial institution and acknowledgement thereof from the financial institution to the first party, said form set including a first top payment sheet and a second bottom receipt sheet, said top sheet having a preprinted payment information area adapted to be filled in by the first party, said second bottom sheet being formed of card stock and being of a size and thickness suitable for mailing as a postcard, said bottom sheet having a preprinted background camouflage pattern area located on the surface facing said top sheet and located immediately below the preprinted payment information area, said camouflage pattern printed in a first predetermined color, the opposite surface of the bottom sheet having an address area and a postage area, said set including means for imprinting payment information on said camouflage pattern in a second predetermined color when the first party writes payment information on the top sheet in the preprinted payment area, whereby when the camouflage pattern area is viewed through a transparent filter medium having a color transmitting frequency freely transmitting the first color but restricting transmission of the second color, the imprinted payment information on the bottom sheet will be visible to the viewer.

2. The payment form and receipt form set of claim 1 wherein said top sheet includes a detachable address part arranged for receiving the address of said first party thereon and adapted to be removed from the main body of the top sheet and to be affixed to the second sheet over the address area on the bottom card sheet.

3. The payment form of claim 2 wherein the address of the financial institution is preprinted in the address area on the bottom sheet so as to be visible through the window of a conventional window envelope when the set is inserted therein, said financial institution address adapted to be covered by said detachable address part having the first party address thereon.

4. The payment and receipt set of claim 1 wherein said means for imprinting on said camouflage pattern includes a carbon sheet located between said top and bottom sheets and adapted to imprint on the lower sheet in said second color.

5. The payment and receipt set of claim 1 wherein said means for imprinting on said camouflage pattern includes a first chemical coating on the lower surface of the top sheet and a second chemical coating on the top surface of the bottom sheet so as to constitute a carbonless two part form, said chemicals reacting under writing pressure to render visible writing in said second color.

6. The payment and receipt set of claim 1 wherein the first color constitutes a narrow red band and said second color constitutes a green band whereby when the camouflage pattern is viewed under a red filter permitting transmission of the red band but restricting transmission of the green band, the green imprinted information will appear darker than the red background pattern.

* * * * *